US006298764B1

(12) United States Patent
Sherman et al.

(10) Patent No.: US 6,298,764 B1
(45) Date of Patent: Oct. 9, 2001

(54) FLASH SUPPRESSOR

(75) Inventors: Andrew J. Sherman, Granada Hills; Jerry Brockmeyer, Valencia; Gregory Peters, North Hollywood; Robert H. Tuffias, Pacoima, all of CA (US)

(73) Assignee: Ultramet, Pacoima, CA (US)

( * ) Notice: Subject to any disclaimer, the term of this patent is extended or adjusted under 35 U.S.C. 154(b) by 0 days.

(21) Appl. No.: 09/483,238

(22) Filed: Jan. 14, 2000

Related U.S. Application Data

(63) Continuation of application No. PCT/US98/14399, filed on Jul. 17, 1998.
(60) Provisional application No. 60/052,842, filed on Jul. 17, 1997.

(51) Int. Cl.[7] ..... F41A 21/00
(52) U.S. Cl. ..... 89/14.2
(58) Field of Search ..... 89/14.1, 14.2, 89/14.3

(56) References Cited

U.S. PATENT DOCUMENTS 2,935,912 * 5/1960 Hartley ..... 89/14.2
4,454,798 * 6/1984 Shea et al. ..... 89/14.2

* cited by examiner

*Primary Examiner*—Charles T. Jordan
*Assistant Examiner*—Nicholas W DiCostanzo
(74) *Attorney, Agent, or Firm*—Bruce A. Jagger

(57) ABSTRACT

A muzzle flash and blast suppressor comprising a body of reticulated refractory foam generally surrounding the projectile path adjacent the muzzle of a device. One side of the body of foam is exposed to the pressure within the projectile path just behind the projectile, and the other side is exposed to the unconfined ambient pressure. The foam is required to be possessed of sufficient structural strength to permit its exterior side to be exposed without confinement to the ambient environment. Hot exhaust gasses flowing laterally of the projectile path pass through the body from the high to the low pressure side. In such passage the gasses are cooled by expansion and by contact with the interstices of the body. Debris is filtered out and the pressure is substantially reduced. Typically, the refractory foam has from approximately 30 to 100 pores per inch and is from approximately 90 to 50 percent void volume.

9 Claims, 3 Drawing Sheets

FLASH SUPPRESSOR

RELATED APPLICATIONS

This application claims the benefit of: (a) continuation PCT application PCT/US98/14399, filed Jul. 17, 1998, which claims the benefit of (b) U.S. Provisional Application No. 60/052,842, filed Jul. 17, 1997.

BACKGROUND OF THE INVENTION

1. Field of the Invention

The invention relates in general to a muzzle device for reducing the flash and blast phenomena which occur during the firing of a firearm or projectile launching device, and, in particular, to such a device comprised of reticulated refractory foam.

2. Description of the Prior Art

Various previous expedients had been proposed as flash suppressors, muzzle brakes/compensators, and silencers for mounting on the ends of gun tubes. Such devices generally consisted of formed steel muzzle extensions including various baffles, machined orifices, and the like. Flash suppression was generally attempted to be achieved by cooling at least part of the muzzle gases below their autoignition temperatures by expanding them through a series of machined orifices, conical ports or the like. Such prior expedients tended to be less effective than desired. The cost of manufacturing such devices, with their numerous intricately formed and assembled components, was substantial.

These and other difficulties of the prior art have been overcome according to the present invention.

BRIEF SUMMARY OF THE INVENTION

A preferred embodiment of a muzzle device according to the present invention comprises a body of high strength refractory foam mounted at the muzzle end of a gun tube so that a significant portion of the gases from the discharge of the weapon exit the gun tube through the foam. Depending upon the nature of the weapon, the muzzle device can be used once or numerous times. When used, for example, on rifled weapons of any caliber (small arms to large naval guns), the muzzle devices are often designed to last for the expected life of the gun barrel, which may be several thousand rounds. Some projectile launching devices, by contrast, may have an expected life of only one firing.

Forcing the hot gases to exit the weapon through reticulated foam cools the gases by expansion, extracts heat from them by contact with the foam ligaments, filters out carbon particles, and the like. The sound (blast) is also attenuated. The high surface area of the foam permits the extraction of considerable heat. The blast overpressure as well as the infrared and visual signatures of the muzzle blast are thus substantially reduced. Primary, intermediate and secondary flash are all suppressed.

Muzzle devices according to the present invention are generally fabricated from refractory foams. In general, the reticulated foams are composed primarily of refractory metals. As will be understood by those skilled in the art, other rigid foams can be used, provided they are possessed of the necessary strength, shock resistance, toughness and thermal resistance. Reticulated foam structures having pore sizes of from approximately 30 to 1000, preferably from approximately 45 to 100, pores per inch, and between approximately 50 to 90 percent porosity (void volume), are particularly suitable for use in muzzle devices. The refractory materials from which muzzle devices according to the present invention can be constructed include, for example, tantalum, niobium, iron aluminide, nickel aluminide, chromium, titanium, nickel or cobalt based high temperature alloys, superalloys, high temperature iron alloys, and the like.

The high strength refractory foams according to the present invention can be fabricated, for example, by chemical vapor deposition techniques where the refractory material is deposited on a carbon skeleton. Other fabrication processes can be utilized, if desired. For example, bath plating and fiber or powder sintering procedures.

The physical shape of the refractory foam can be adjusted so as to maximize the effect of the foam structure on the hot gases. The refractory foam can also be shaped to perform the functions performed by solid elements in previous expedients or combined with solid elements or baffles. For example, the refractory foam can be configured into baffles, and the like.

Various materials can be incorporated into the foam structure so as to improve or add additional functions to those provided by the foam. For example, sublimation materials or materials which react with the hot gasses can be included within the interstices of the foam, if desired. Materials with high heats of sublimation cool the gases. Such sublimation materials include, for example, polyvinyl alcohol, oxalic acid, sodium or potassium chloride, and the like. Materials which react with the hot muzzle discharge gases to suppress the flash include, for example, sodium carbonate, potassium carbonate, and the like.

BRIEF DESCRIPTION OF THE DRAWINGS

Referring particularly to the drawings for the purposes of illustration only, and not limitation.

DETAILED DESCRIPTION OF THE PREFERRED EMBODIMENTS

Figure 2:
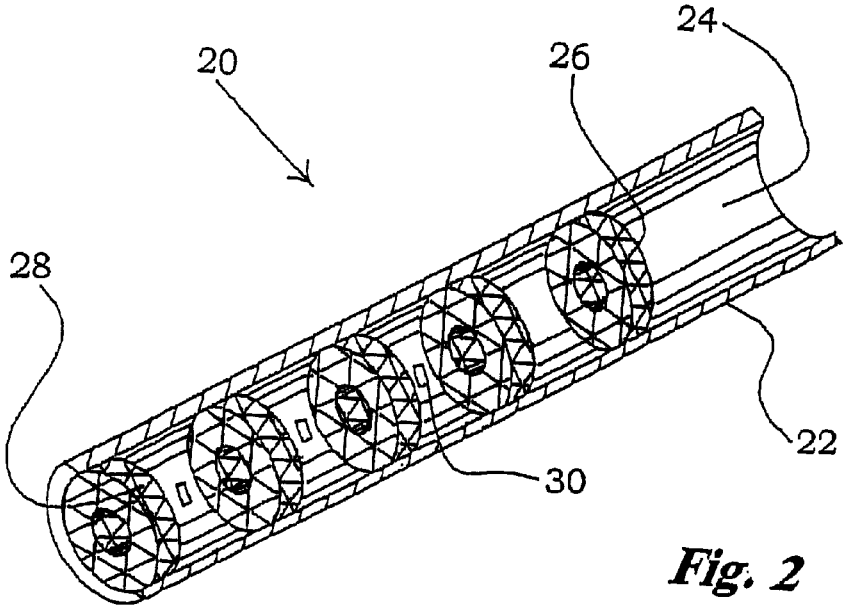
FIG. 2 is an isometric cross-sectional view of a blast suppressor according to the present invention wherein the baffles are composed of reticulated refractory foam.

Referring particularly to the drawings, there is illustrated generally at 10 a muzzle device including a reticulated, refractory foam body 12 having an axial bore 16. The muzzle device 10 is adapted to be mounted to the muzzle of gun tube 14 with the bore 16 in alignment with and substantially the same diameter as the bore of the gun tube. A projectile leaves the muzzle of gun tube 14 and passes through axial bore 16. As the projectile is passing through the axial bore, gas and debris generated by firing the weapon exit the system laterally through the pores in the reticulated foam body 12. Debris is trapped within the interstices of body 12. The gas expands as it passes laterally through the body 12. It is cooled by this expansion and by contact with the ligaments of the body 12. The use, for example, of a reticulated foam tantalum body having a diameter which is approximately twice the diameter of the bore of the gun tube, a length of approximately 6 times the diameter of the bore of the gun tube, a porosity (void volume) of approximately 80 percent, and approximately 80 pores per inch, provides almost complete elimination of the muzzle flash from a 30 caliber rifle.

Referring particularly to FIG. 2, there is illustrated generally at 20, a blast reduction device wherein the baffles, of which 26 and 28 are typical, are composed of discs or cones of reticulated refractory foam. The muzzle receiving or socketing portion 24 is adapted to receive the muzzle end of a gun tube in a snug sliding fit. In addition to filtering out debris and cooling the gas, discs 26 and 28 also attenuate the sound of firing the weapon. Ports, a typical one of which is illustrated at 30, also vent gas laterally from the system.

Figure 5:
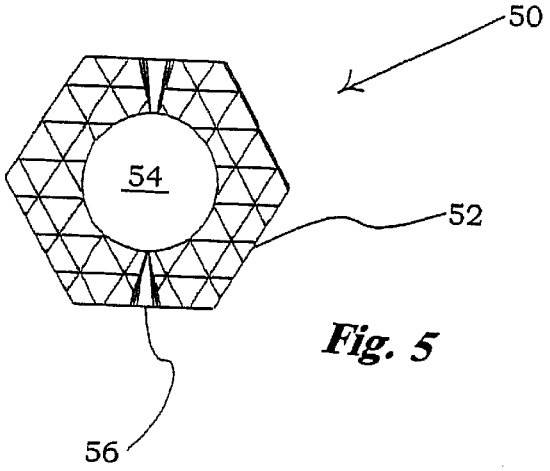
FIG. 5 is a cross-sectional view of an additional embodiment of a hollow cored body of reticulated refractory foam according to the present invention.
Figure 4:
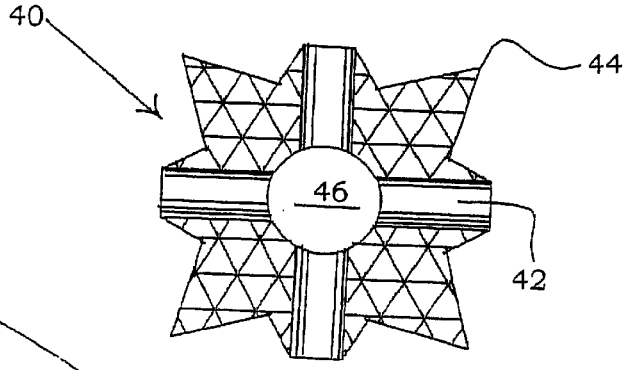
FIG. 4 is a cross-sectional view of an additional embodiment of a hollow cored body of reticulated refractory foam according to the present invention.
Figure 3:
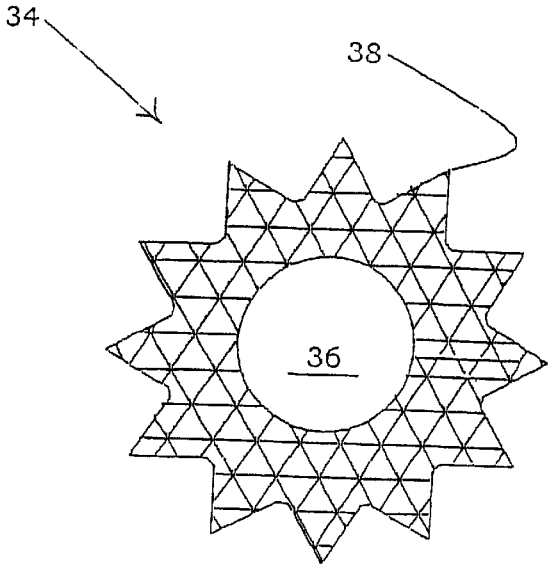
FIG. 3 is cross-sectional view of a further embodiment of a hollow cored body of reticulated refractory foam according to the present invention.

FIGS. 3, 4 and 5 are cross-sectional views of various configurations of flash suppressors according to the present invention. The muzzle device indicated generally at 34, permits the venting of a portion of the gas through the thinner wall sections between the central bore 36 and the periphery of the device 34. Maximum expansion and filtering are provided to those gasses which travel the longest paths from bore 36 to the exterior periphery of refractory, reticulated foam body 38. The reduced wall thickness areas provide a venting effect without forming ports which extend entirely through the wall of body 34.

Referring particularly to FIG. 4, there is illustrated at 40 a body of reticulated, refractory foam 44 which is ported for the relief of pressure. A typical port is shown at 42. Port 42 through the body 44 is shown as straight walled. As will be understood by those skilled in the art other configurations, for example, coned, can be used if desired.

Referring particularly to FIG. 5, there is illustrated generally at 50 a muzzle device which includes a body of refractory, reticulated foam 52. Body 52 is provided with a central bore 54 and lateral conical expansion ports, of which 56 is typical. The conical shape of the ports 56 causes the gas to expand, thus cooling it and reducing its velocity.

When sublimation and/or reactive materials are included within the foam structure, generally they are coated onto the ligaments of the foam. This reduces the porosity of the foam somewhat, however, generally, they are not provided in such a way as to plug any significant number of the pores of the foam.

Figure 6:
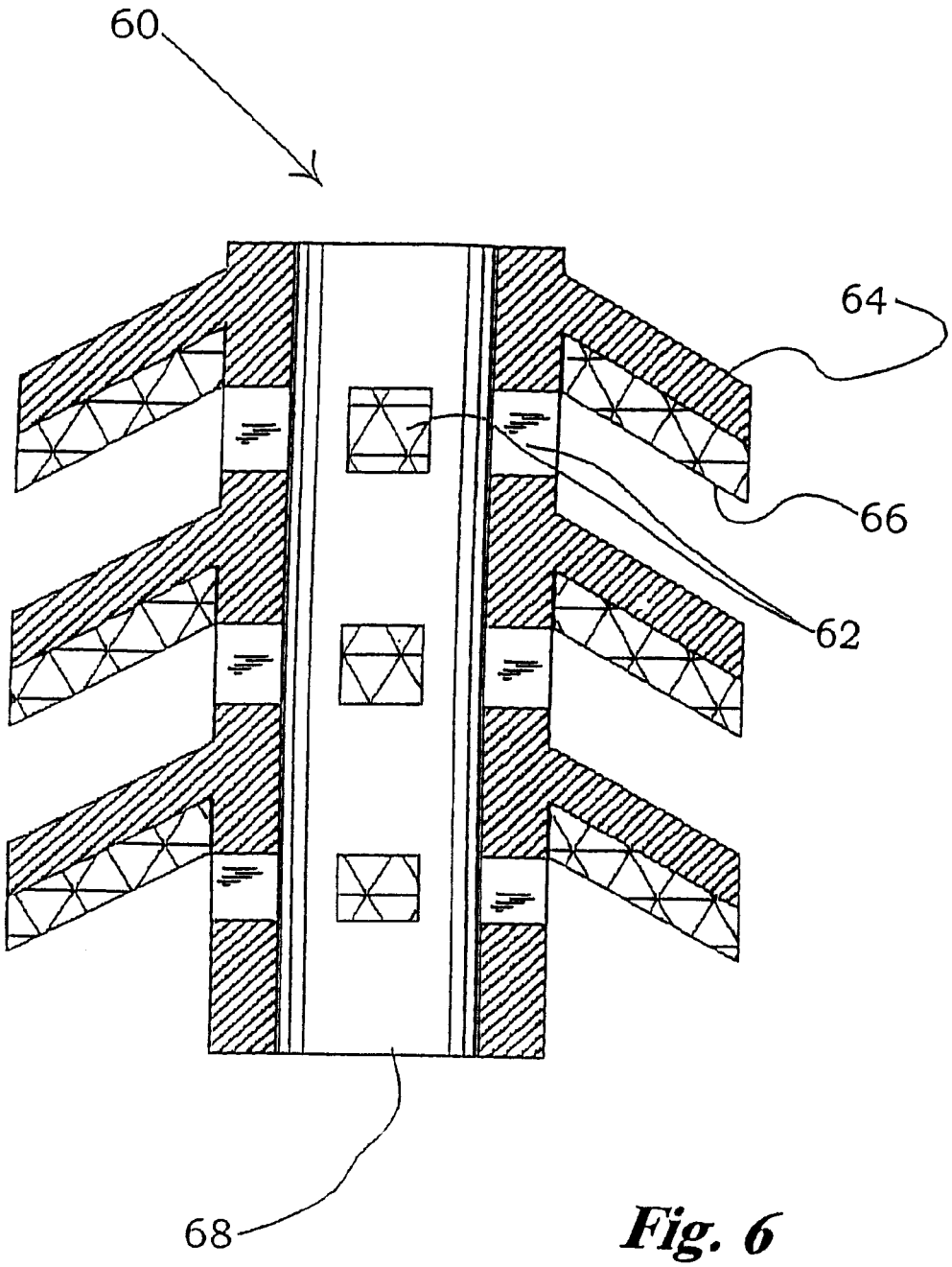
FIG. 6 is a cross-sectional view illustrating the use of a foam lining on the blast facing surfaces of a muzzle brake device to reduce the muzzle blast overpressure created by the muzzle break according to the present invention.

Referring particularly to FIG. 6, there is illustrated generally at 60, a muzzle brake which is fabricated from solid metal. Muzzle brake 60 includes lateral expansion ports, typical ones of which are illustrated at 62, baffles angled towards the breach of the gun tube, a typical one of which is illustrated at 64, and, conical, reticulated, refractory, foam baffle liners, a typical one of which is illustrated at 66. The muzzle brake is adapted to be mounted to the muzzle of a gun tube at 68. The muzzle brake 60 serves to reduce recoil, and the foam baffle liners serve to reduce the blast overpressure created by the muzzle brake by from approximately 3 to 10 decibels.

Figure 1:
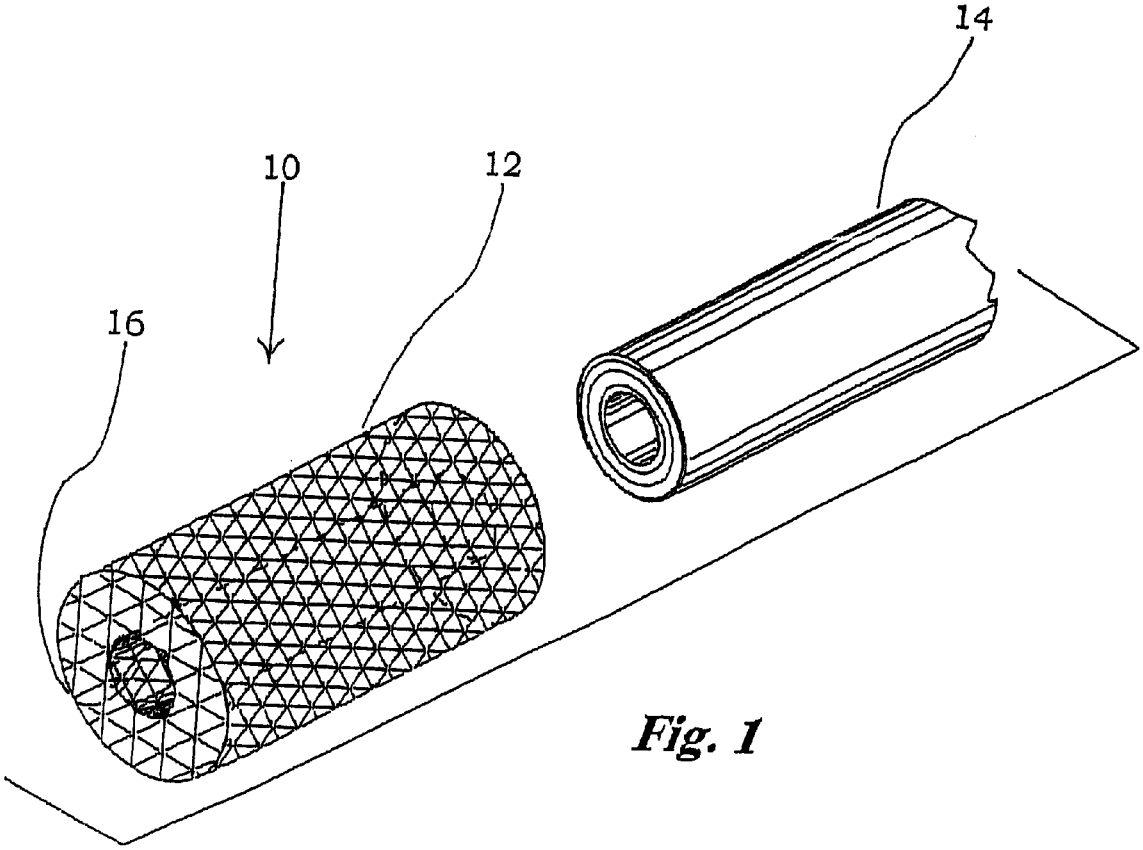
FIG. 1 is an exploded isometric view of a preferred embodiment of the invention showing a cylindrical hollow cored body of reticulated refractory foam and a gun tube muzzle.

The effectiveness of various reticulated foam bodies in suppressing the flash at the muzzle of an AR15 carbine (0.223 caliber) was tested. Several cylindrical, hollow-cored, reticulated foam flash suppressors, substantially as shown in FIG. 1, were fabricated from niobium and rhenium, respectively. The pore sizes were held substantially constant within each flash suppressor. The pore sizes from suppressor to suppressor ranged from about 45 pores per lineal inch (ppi) to 100 ppi. The bulk densities ranged from 10 percent dense (90 percent pores) to 30 percent dense (70 percent pores) between the respective suppressors. cylinder lengths ranged from about 2.25 inches (approximately 10 bore diameters for the 0.223 caliber weapon which was used in these tests) to about 4.9 inches (about 22 bore diameters). The outer diameters of the respective suppressors ranged from about 0.75 inches (about 3 bore diameters) to about 0.95 inches (about 4 bore diameters). The bores of the respective suppressors ranged from about 0.024 to 0.028 inches.

The cylindrical foamed bodies were mounted to the muzzle of the weapon by means of being inserted in closely fitting slotted steel cans that included a section that conformed to the exterior of the muzzle. Approximately 50 percent of the area of the slotted cans was removed by the slotting operation. The slotted cans were used as a means to mount the suppressors to the muzzle, not because the structural strength of the cans was required to support the reticulated refractory metal suppressors.

The suppressors were tested by firing the weapon and observing the flash by the unaided eye and by recording it with a conventional home video. The results were obtained by subjective visual comparison and semi-quantitative. image analysis of the flash images recorded on the conventional home video. Testing consisted of firing multiple rounds through the weapon in each of the following configurations: nothing on the muzzle, a conventional flash suppressor on the muzzle, a slotted can only on the muzzle, and with each of the suppressors in turn mounted on the muzzle in slotted cans.

Substantial flash suppression was observed for each of the reticulated refractory foam cylinders. A rapid heat rise was noted for each of the suppressors, indicating a high heat transfer rate and resultant significant cooling of the exhaust gas. The 65 and 100 ppi suppressors appeared to provide greater reduction in flash signature than the 45 ppi suppressors. Refractory foams with bulk densities of less than about 20 percent tended to disintegrate with only one or two firings. Finer pore sizes with a given bulk density tended to be more effective in reducing the flash signature, however, the finer pore sizes tended to be less durable. The 65 ppi suppressors were generally more durable than the 100 ppi suppressors of the same bulk density. In general, pore sizes and density need to be balanced to achieve the desired performance. Where a weapon is only going to be fired once with a given flash suppressor, maximum flash suppression can be achieved by using the smallest possible pore size and the lowest possible density which will withstand one firing. Where many firings are to be made, larger pore sizes and higher bulk densities should generally be used. Also, stronger materials can be used to achieve greater durability. Some missile launchers, for example, may only be fired once, while small arms may be fired many times. While foam bodies with as many as 1000 pres per inch can be used in some circumstances, in general, pore sizes below about 300 pores per inch tend to be less effective.

Reticulated niobium foam blocks were clamped over the ports in the muzzle brake of a Barrett 0.50 caliber rifle so that exhaust gases exiting the muzzle brake laterally would necessarily pass through the refractory foam. The foam blocks were exposed to ambient pressure on the outside, and to muzzle discharge pressures on the inside. The hot gasses and blast pressure exiting the conventional muzzle brake on this weapon are of sufficient strength that a large clear area must be maintained surrounding the shooter. The reticulated foam substantially attenuated and dispersed the blast without adversely affecting the weapons performance or recoil. Reticulated rhenium foam blocks used similarly also were effective in attenuating and dispersing the blast and flash.

In general, the composition of the reticulated foam does not appear to have a significant impact on the effectiveness of the suppressor, provided they exhibit the necessary physical strength at the temperatures which are involved. Higher heat capacity materials would be expected to perform better, however, the differences do not, as a practical matter, appear to be significant. The pore size and void volume appear to be of greater significance.

Various ceramics which are both thermal and impact resistant, such as, for example, silicon carbide, and the like, can be used as the refractory foam according to the present invention. Also reticulated nickel foam is effective as a flash and blast suppressor. With a melting point of about 2651 degrees Fahrenheit, nickel is considered for the purposes of this invention to be a refractory metal.

According to the present invention, a significant portion of the hot gases generated by the firing of the device pass out of the flash suppressor system laterally through the foam. In some systems this can be as much as 50 percent or more of the total gas flow. Much of this lateral flow is believed to take place while the projectile is still within the bore of the flash suppressor system. It is believed that the amount of gas flowing laterally through the foam body is enhanced by having the exterior surface of the foam exposed to ambient pressure. Pressure does not build up on the exterior of the suppressor as it would if the foam were confined within a closed chamber. The system is surrounded by the ambient environment. The foam is positioned so that the hot exhaust gases pass laterally from the axis of the projectile path through the reticulated foam from its interior to exterior surfaces, and is discharged directly to the ambient environment. Preferably, all of the hot gas which flows laterally immediately downstream of the muzzle passes through the reticulated foam before it is ejected into the ambient environment. See, for example, FIGS. 1, 2 and 3. When desired, however, it is possible to allow part of the lateral flow to bypass the reticulated foam as shown, for example, in FIGS. 4, 5 and 6. In the embodiment of FIG. 6, the laterally flowing jet of hot exhaust gas impinges on the surface of the reticulated foam. Some gas flows through the foam and out the end of the foam into the ambient environment. The rest of the gas is reflected off of the foam and is ejected into the ambient environment. In general, this is not as effective as those configurations where all of the laterally flowing gas passes through the body of the filter. It may, however, be necessary in some situations.

Maximum effectiveness in flash and blast reduction are believed to be achieved by allowing the hot exhaust gases to pass laterally through the reticulated refractory foam body while subject to the full pressure differential which exists between the gas at the muzzle and the ambient environment outside of the system. To this end, the exterior of the foam is generally exposed to the ambient environment without confinement. Being unconfined permits the gasses to expand away from the exterior surface to the maximum extent and at the maximum rate possible. The structural characteristics of the foam must be such that they can withstand such pressure pulses without additional confining structure. Various mounting members can be employed around the foam body to aid in mounting it to the muzzle or to protect it during handling and storage, if desired. The casing in FIG. 2, for example, serves this purpose. While the encountered pressure differentials differ greatly depending upon the nature of the device which is being fired (for example, small arms, cannon, missile launchers, or the like), these pressure differentials typically amount to several thousand pounds per square inch.

The refractory foams according to the present invention typically are required to withstand instantaneous thermal pulses which reach as high as 1000 to 2000 degrees Centigrade, or higher. Exhaust gas temperatures vary widely with, inter alia, the nature of the propellant and the configuration of the device in which they are fired. The refractory foam which is selected for a particular purpose should be capable of withstanding the anticipated thermal shock and peak temperatures.

Typical manufacturing procedures, by which foam structures which are suitable for use according to the present invention are made, are disclosed, for example, in Kaplan U.S. Pat. No. 5,282,861, and Duffy et al. U.S. Pat. No. 5,372,380, the disclosures of which is hereby incorporated herein by reference. The reticulated foam disclosed in Duffy et al. U.S. Pat. No. 5,372,380, is well suited for use as muzzle devices according to the present invention.

What has been described are preferred embodiments in which modifications and changes may be made without departing from the spirit and scope of the invention.

What is claimed is:

1. A muzzle flash and blast suppression system for reducing flash and blast from a firearm, said firearm including a barrel having a projectile bore therein, said barrel terminating at a muzzle, said projectile bore being adapted to confine hot exhaust gases as said weapon is fired, said system comprising:

a body of reticulated refractory foam having a generally cylindrical bore therethrough, said body being adapted to being mounted as an extension of said muzzle with said generally cylindrical bore in coaxial alignment with said projectile bore and positioned to receive said hot exhaust gases from said projectile bore, said body being adapted to receive hot gases from said generally cylindrical bore and pass them laterally therethrough and out of said system.

2. A muzzle flash and blast suppression system mounted to a firearm or projectile launching device for reducing flash and blast from said device, said device including a barrel having a projectile bore therein, said barrel terminating at a muzzle, said projectile bore being adapted to confine hot exhaust gases as said device is fired, comprising:

a body of reticulated refractory foam having a generally cylindrical bore therethrough, said body being mounted as an extension of said muzzle with said generally cylindrical bore in coaxial alignment with said projectile bore and positioned to receive said hot exhaust gases from said projectile bore, said body being adapted to receive hot gases from said generally cylindrical bore and pass them laterally therethrough and out of said system.

3. A muzzle flash and blast suppression system comprising:

a body of reticulated refractory foam having an exterior surface open to the ambient environment and a generally cylindrical bore therethrough, said body being adapted to being mounted as an extension of the muzzle of a firearm or projectile launching device with said generally cylindrical bore being positioned in substantial axial alignment with a projectile bore of said device, said body being adapted to pass hot exhaust gas generated by the firing of said device laterally through said body from said generally cylindrical bore to said exterior surface.

4. A method of suppressing muzzle flash and blast from the discharge of a firearm or projectile launching device wherein hot exhaust gas generated by firing said device is discharged from a muzzle of said device in an axial direction, and is allowed to expand laterally after exiting said muzzle, said method comprising:

placing a reticulated refractory foam body adjacent said muzzle and offset laterally from said axis, said foam body having an interior surface adjacent said axis, and an exterior surface exposed to the ambient environment; and allowing a portion of said hot exhaust gas to travel laterally through said reticulated foam body from said interior to said exterior surfaces and into the ambient environment.

5. A process of claim 4 including allowing substantially all of the hot exhaust gas which expands laterally to travel laterally through said reticulated foam body from said interior to said exterior surfaces.

6. A method of suppressing muzzle flash and blast from the discharge of a firearm or projectile launching device wherein hot exhaust gas generated by firing said device is discharged from a muzzle of said device in an axial direction, and is allowed to expand laterally after exiting said muzzle, said muzzle being surrounded by an unconfined ambient environment, said method comprising:

selecting a refractory reticulated foam body having about 30 to 1000 pores per inch and a void volume of from about 50 to 90 percent;

placing said refractory reticulated foam body adjacent said muzzle and offset laterally from said axis, said foam body having an interior surface adjacent said axis, and an exterior surface exposed to the unconfined ambient environment;

firing said device to generate said hot exhaust gas; and allowing a portion of said hot exhaust gas to travel laterally through said reticulated foam body from said interior to said exterior surfaces and into the ambient environment.

7. A method of claim 6 including selecting a refractory reticulated foam body having about 45 to 100 pores per inch.

8. A method of claim 6 including selecting a refractory reticulated foam body which includes sublimation materials incorporated therein.

9. A method of claim 6 including selecting a refractory reticulated foam body which comprises tantalum, niobium, rhenium, iron aluminide, nickel aluminide, chromium, titanium, nickel, cobalt based high temperature alloys, superalloys, or high temperature iron alloys.

* * * * *